US008142212B2

(12) United States Patent
McSweeney et al.

(10) Patent No.: US 8,142,212 B2
(45) Date of Patent: Mar. 27, 2012

(54) LOCKING MECHANISMS AND LOCKING CAPS FOR USB CONNECTORS

(75) Inventors: Mark McSweeney, San Francisco, CA (US); Chung-Sheng Chen, Taichung (TW)

(73) Assignee: Imation Corp., Oakdale, MN (US)

( * ) Notice: Subject to any disclaimer, the term of this patent is extended or adjusted under 35 U.S.C. 154(b) by 0 days.

(21) Appl. No.: 12/813,473

(22) Filed: Jun. 10, 2010

(65) Prior Publication Data

US 2011/0008981 A1 Jan. 13, 2011

Related U.S. Application Data

(60) Provisional application No. 61/185,984, filed on Jun. 10, 2009.

(51) Int. Cl.
*H01R 13/44* (2006.01)

(52) U.S. Cl. ..... 439/135

(58) Field of Classification Search ..... 439/135, 439/352, 353

See application file for complete search history.

(56) References Cited

U.S. PATENT DOCUMENTS

| | | | | |
|---|---|---|---|---|
| 6,976,633 | B2 * | 12/2005 | Kimura | 235/486 |
| 7,223,574 | B2 * | 5/2007 | Lei et al. | 435/135 |
| 7,241,153 | B2 * | 7/2007 | He et al. | 439/148 |
| 7,275,941 | B1 * | 10/2007 | Bushby | 439/133 |
| 2006/0172599 | A1 * | 8/2006 | Hankey et al. | 439/607 |
| 2007/0037454 | A1 * | 2/2007 | Bushby | 439/680 |
| 2007/0111583 | A1 * | 5/2007 | Cuellar et al. | 439/353 |

* cited by examiner

*Primary Examiner* — Phuong Dinh

(74) *Attorney, Agent, or Firm* — Kenneth E. Levitt; Dorsey & Whitney LLP

(57) ABSTRACT

According to various embodiments, an exemplary locking mechanism for a USB connector comprises a hook, a hook bracket at least partially inserted within the hook to form a first assembly, a holder, the holder enclosing at least a portion of the first assembly to form a second assembly, and a button, the button enclosing at least a portion of the second assembly to form the locking mechanism. The locking mechanism may further comprise a spring fitted around a protruding portion of the hook bracket, the protruding portion extending outward from the first assembly. The locking mechanism may further comprise one or more screws attaching the first assembly to the holder to form the second assembly. The locking mechanism may include a cap enclosing at least a portion of the button to form a locking cap.

20 Claims, 15 Drawing Sheets

LOCKING MECHANISMS AND LOCKING CAPS FOR USB CONNECTORS

CROSS-REFERENCE TO RELATED APPLICATIONS

This application claims the benefit and priority of U.S. Provisional Patent Application Ser. No. 61/185,984, filed on Jun. 10, 2009, titled "Locking Cap", which is incorporated by reference herein.

BACKGROUND

1. Field of the Invention

The present application relates generally to various configurations (e.g. 1.0, 2.0, mini, micro, etc.) of a Universal Serial Bus ("USB") connector, and more particularly, to locking caps or locking mechanisms for a USB connector.

2. Background Art

A USB connector generally inserts into a downstream port receptacle on a USB host, or a hub, and carries power and/or data.

SUMMARY OF THE INVENTION

According to various embodiments, an exemplary locking mechanism for a USB connector comprises a hook, a hook bracket at least partially inserted within the hook to form a first assembly, a holder, the holder enclosing at least a portion of the first assembly to form a second assembly, and a button, the button enclosing at least a portion of the second assembly to form the locking mechanism. The locking mechanism may further comprise a spring fitted around a protruding portion of the hook bracket, the protruding portion extending outward from the first assembly. The locking mechanism may further comprise a screw attaching the first assembly to the holder to form the second assembly. The locking mechanism may include a cap enclosing at least a portion of the button to form a locking cap. A USB connector may be at least partially inserted within the locking cap to attach the locking cap to the USB connector. The locking cap may be detached from the USB connector by applying pressure to a portion of the button. Alternatively, the USB connector may be at least partially inserted within the locking mechanism to attach the locking mechanism to the USB connector. Additionally, the USB connector may be communicatively coupled with a portable storage device.

According to another embodiment, a locking mechanism for a portable storage device may comprise a hook, a hook bracket at least partially inserted within the hook to form a first assembly, a holder, the holder enclosing at least a portion of the first assembly to form a second assembly, and a release mechanism, the release mechanism associated with at least a portion of the second assembly to form the locking mechanism. A USB connector may be at least partially inserted within the locking mechanism to attach the locking mechanism to the USB connector. The locking mechanism may be detached from the USB connector by actuation of the release mechanism.

According to yet a further embodiment, a locking cap for a portable storage device may comprise a hook, a hook bracket at least partially inserted within the hook to form a first assembly, a holder, the holder enclosing at least a portion of the first assembly to form a second assembly, a button, the button enclosing at least a portion of the second assembly to form the locking mechanism, a spring fitted around a protruding portion of the hook bracket, the protruding portion extending outward from the first assembly, a screw attaching the first assembly to the holder to form the second assembly, and a cap, the cap enclosing at least a portion of the button to form the locking cap. A USB connector may be at least partially inserted within the locking cap to attach the locking cap to the USB connector. The locking cap may be detached from the USB connector by applying pressure to a portion of the button.

DETAILED DESCRIPTION

Figure 1:
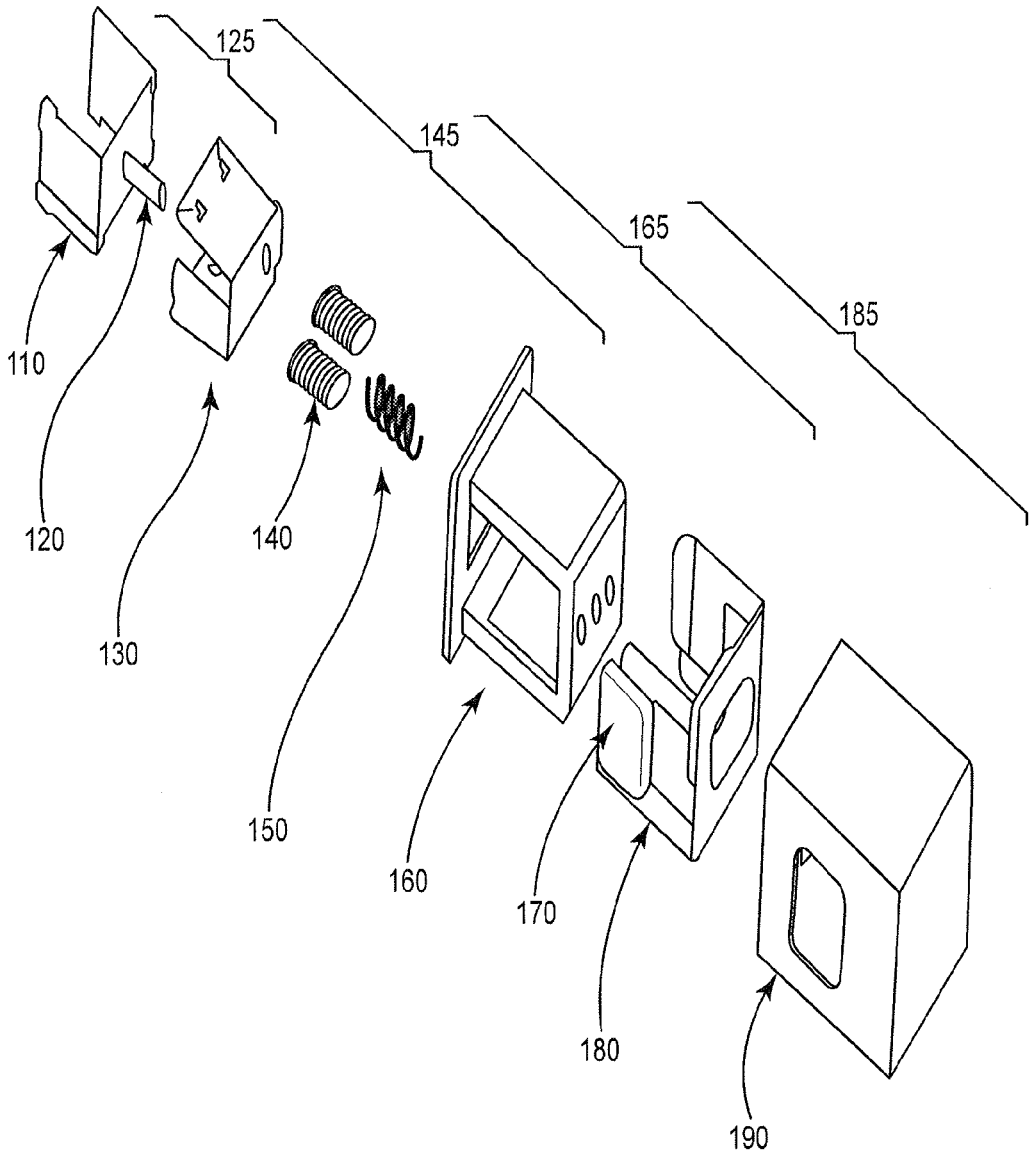
FIG. 1 shows various components of a locking mechanism or a locking cap, according to some exemplary embodiments.

FIG. 1 shows various components of a locking mechanism or a locking cap, according to some exemplary embodiments. Shown in FIG. 1 are a hook bracket 110, a protruding portion 120 of the hook bracket 110, a first assembly 125, a hook 130, one or more screws 140, a second assembly 145, a spring 150, a holder 160, a locking mechanism 165, a portion 170 of button 180, button 180, a locking cap 185, and a cap 190.

According to some embodiments, the locking mechanism 165 may be formed by at least partially inserting the hook bracket 110 into the hook 130 to form the first assembly 125. The first assembly 125 may be at least partially inserted into the holder 160, so as to enclose at least a portion of the first assembly 125, thus forming the second assembly 145. The second assembly 145 may be at least partially inserted into the button 180, so as to enclose at least a portion of the second assembly 145, thus forming the locking mechanism 165.

In further exemplary embodiments, a locking mechanism or a locking cap maybe formed by the spring 150 being fitted around a protruding portion 120 of the hook bracket 110, after the hook bracket 110 has been at least partially inserted into the hook 130 to form the first assembly 125. In yet further exemplary embodiments, one or more screws 140 may be used to attach the holder 160 to the button 180 to form a locking mechanism. The locking mechanism may be at least partially inserted into the cap 190 so as to enclose at least a portion of the locking mechanism to form a locking cap.

In various exemplary embodiments, a USB connector (not shown) may be at least partially inserted into a locking mechanism or into a locking cap in order to attach the USB connector to the locking mechanism or to the locking cap. Accordingly, the locking mechanism or the locking cap may be detached from the USB connector by applying pressure to the portion 170 of button 180.

Figure 2:
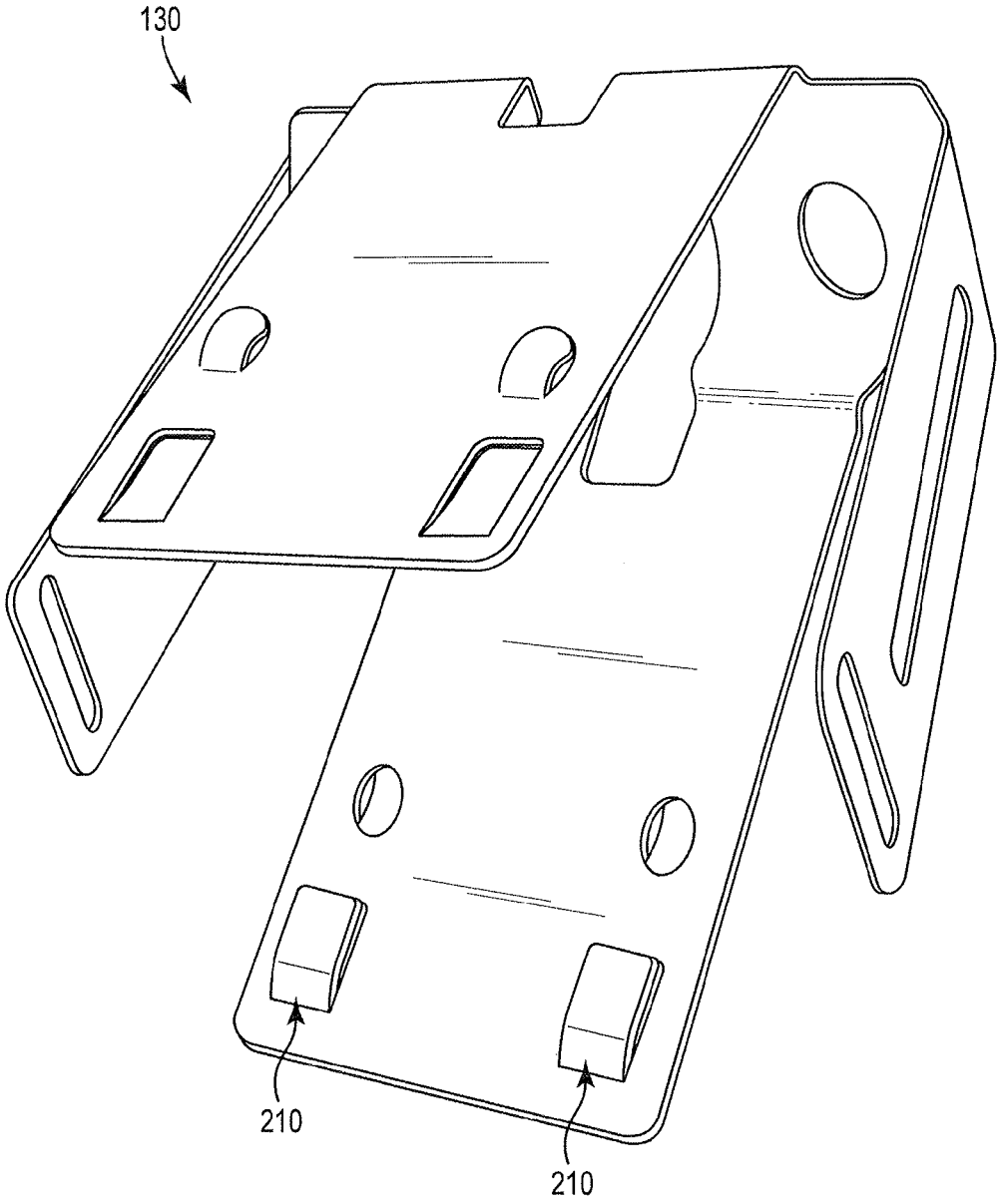
FIG. 2 is a picture of an exemplary hook, according to one embodiment.

FIG. 2 is a picture of an exemplary hook 130, according to one embodiment. The exemplary hook 130 includes one or more engagement points 210. Engagement points may be located at various places on a hook, including at places opposing the illustrated engagement points 210, such as on the upper side of the exemplary hook 130. As will be further described herein, at least a portion of the engagement points 210 within the interior of the hook 130 may interact (e.g. engage or disengage) with at least a portion of a USB connector (not shown).

Figure 3:
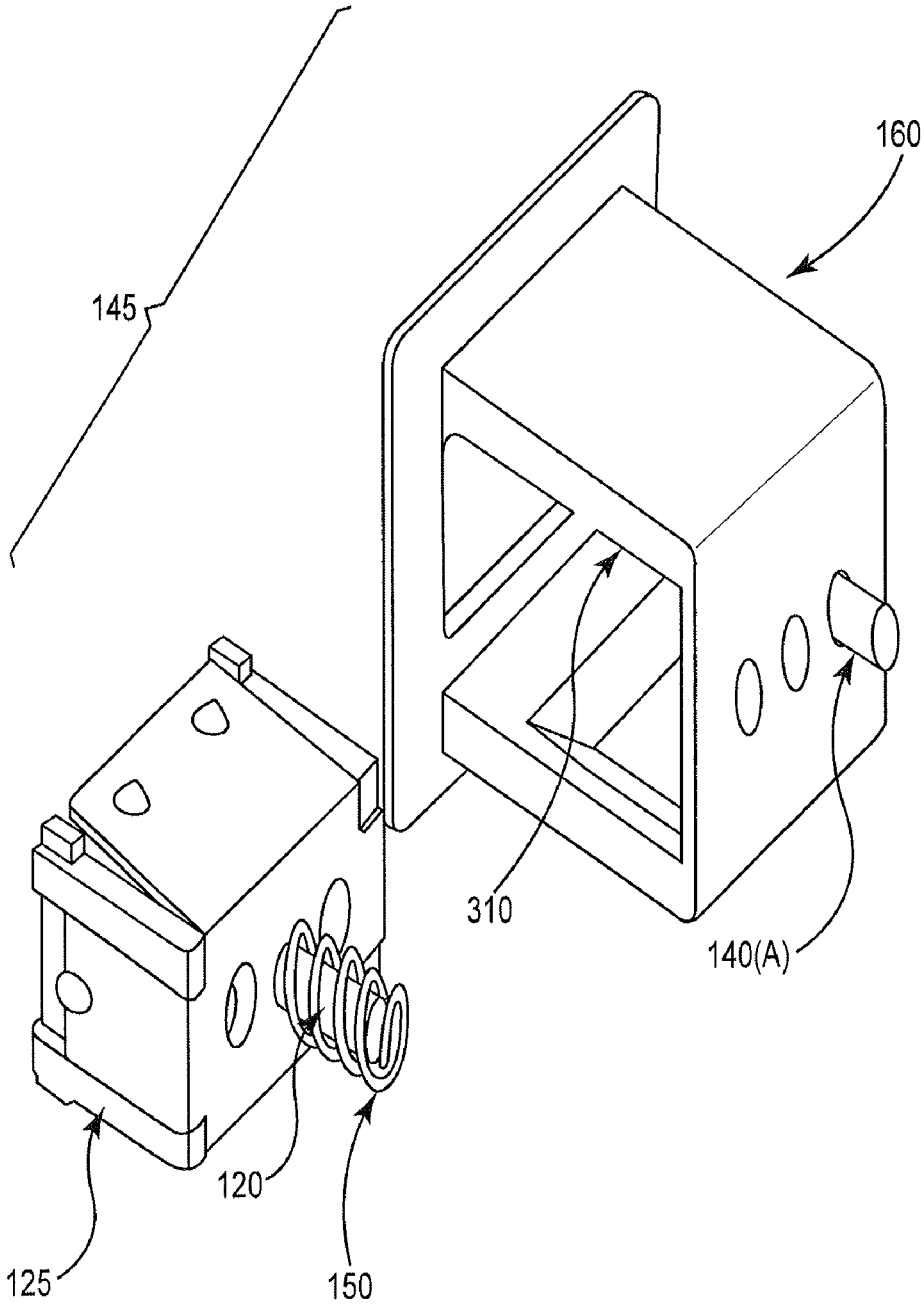
FIG. 3 shows an exemplary second assembly, according to various embodiments.

FIG. 3 shows an exemplary second assembly 145, according to various embodiments. Shown in FIG. 3 are a first assembly 125, a protruding portion 120 of a hook bracket, a screw 140(A), a spring 150, a holder 160, and side 310 of the holder 160. The exemplary second assembly 145 may be assembled by inserting or sliding the first assembly 125 through side 310 of the holder 160. The second assembly 145 may be assembled with or without one or more screws (e.g. screw 140(A)) and/or with or without a spring (e.g. spring 150).

Figure 4:
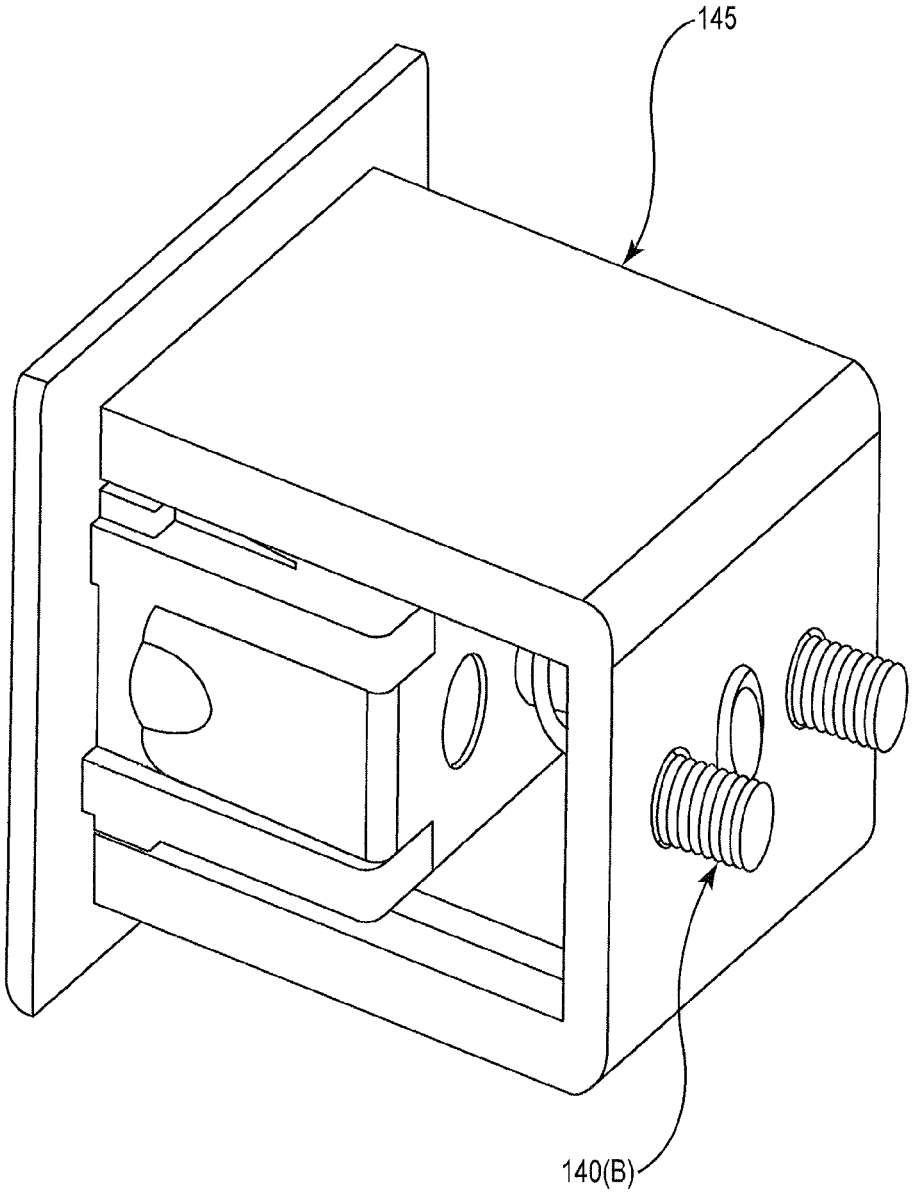
FIG. 4 shows another view of the exemplary second assembly, after assembly as shown and described in connection with FIG. 3 herein.

FIG. 4 shows another view of the exemplary second assembly 145, after assembly as shown and described in connection with FIG. 3 herein. In general, the screw 140(B) may be installed after completing the assembly as shown and described in connection with FIG. 3.

Figure 5:
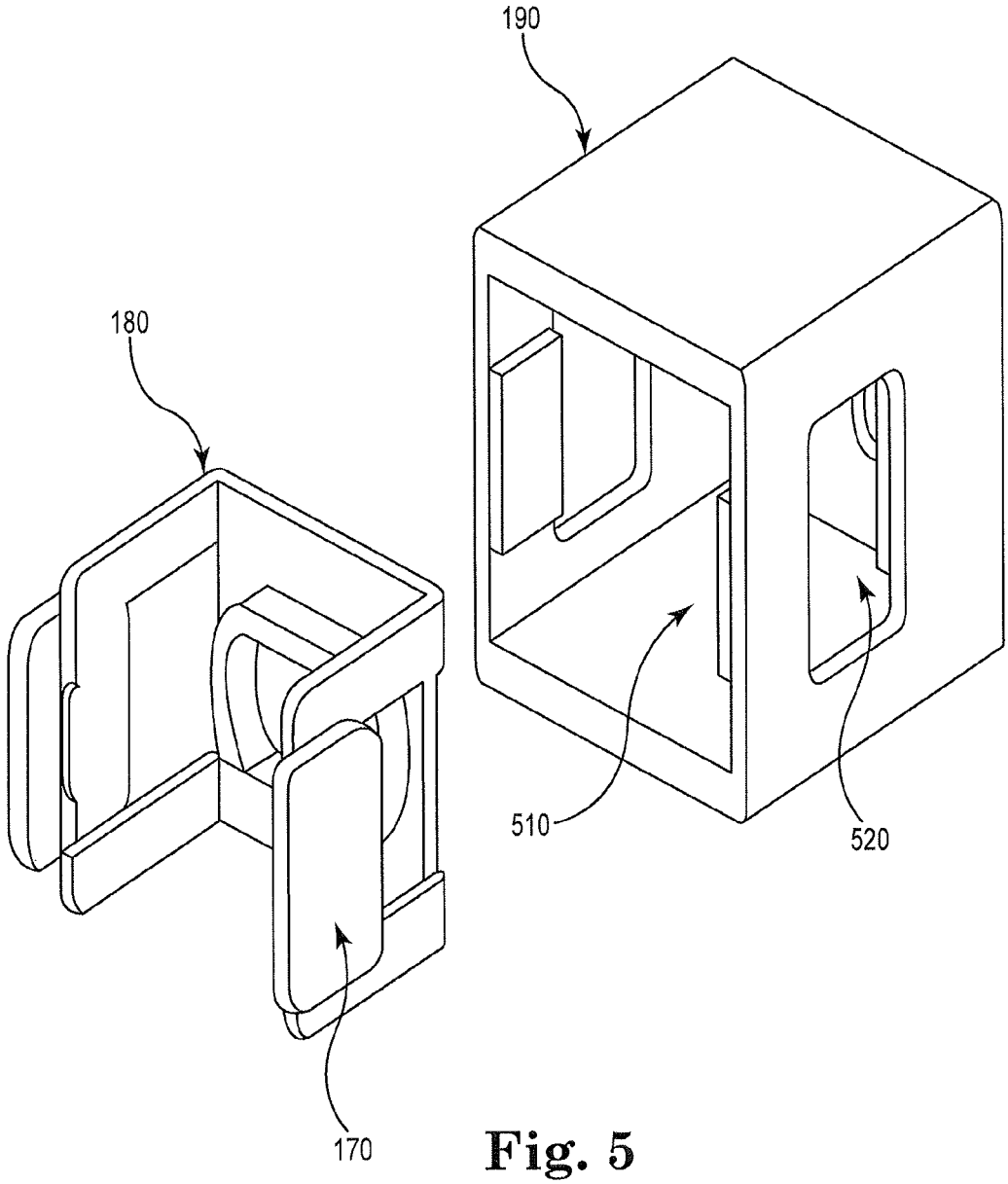
FIG. 5 shows an alternative method of assembling the button and the cap.

FIG. 5 shows an alternative method of assembling the button 180 and the cap 190. Shown in FIG. 5 are a portion 170 of button 180, button 180, a cap 190, front side 510 of the cap 190, and side 520 of the cap 190. According to one embodiment, the button 180 may be at least partially inserted into the front side 510 of the cap 190, so as to allow the portion 170 of button 180 to appear within side 520 of the cap 190. In some embodiments, a second portion of a button may appear in an opposing side of a cap.

Figure 6:
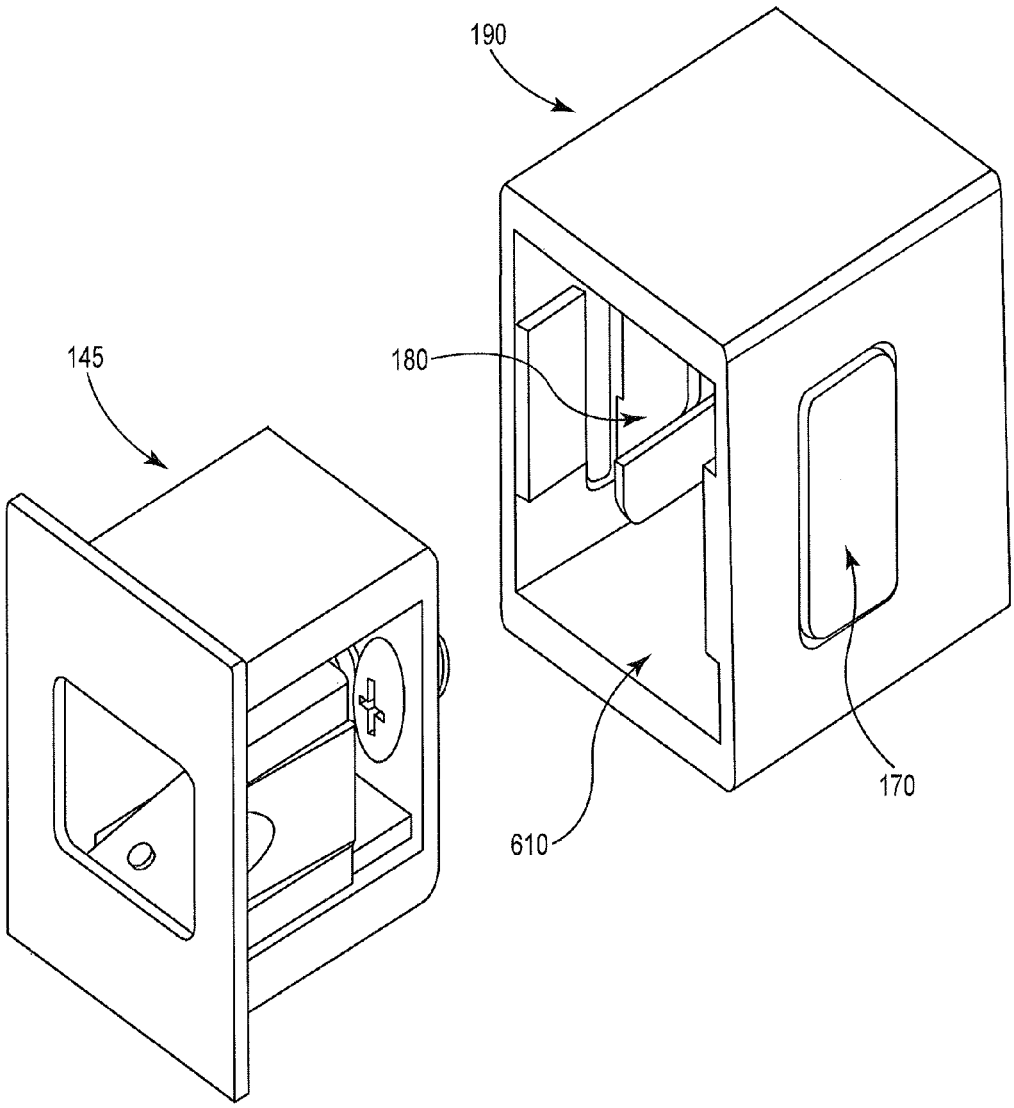
FIG. 6 shows an alternative method of assembling a locking cap.

FIG. 6 shows an alternative method of assembling a locking cap. Shown in FIG. 6 are the resulting second assembly 145, as shown and described in connection with FIG. 4 herein, and the resulting assembly as shown and described in connection with FIG. 5 herein. According to one embodiment, the resulting second assembly 145 may be at least partially inserted into the front side 610 of the resulting assembly of FIG. 5, to form the locking cap.

Figure 7:
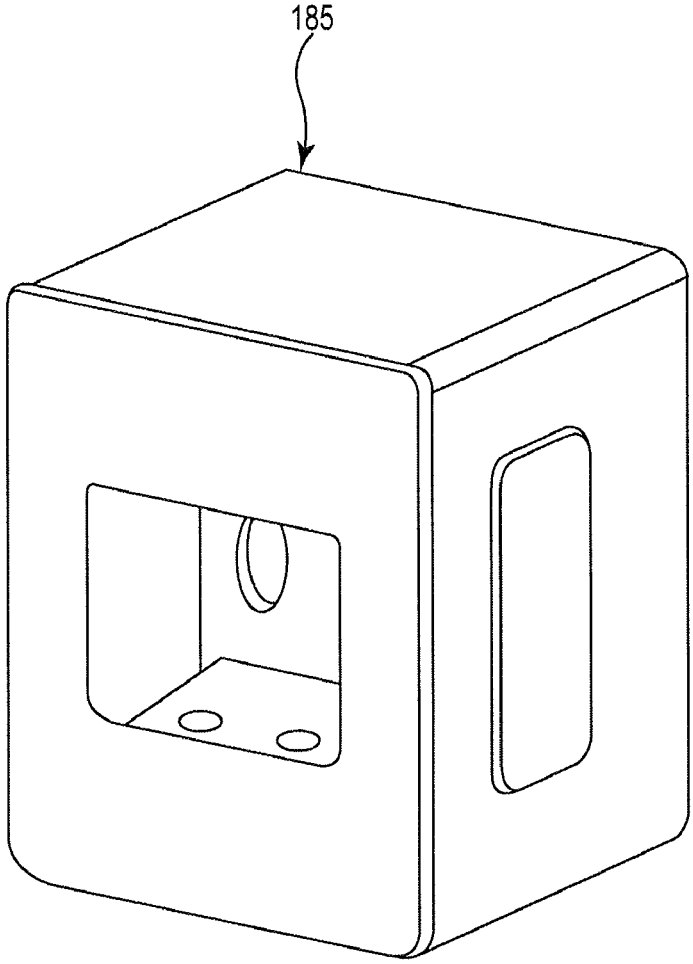
FIG. 7 shows one embodiment of an exemplary locking cap.

FIG. 7 shows one embodiment of an exemplary locking cap 185. Various methods may be employed to assemble the locking cap 185 (or locking mechanisms), such as those described herein or other methods. The locking caps and locking mechanisms described herein may be used with various USB connectors (e.g. configurations) that are associated with various forms of digital devices (e.g. cables, computers, cameras, game consoles, storage devices, etc).

Figure 8:
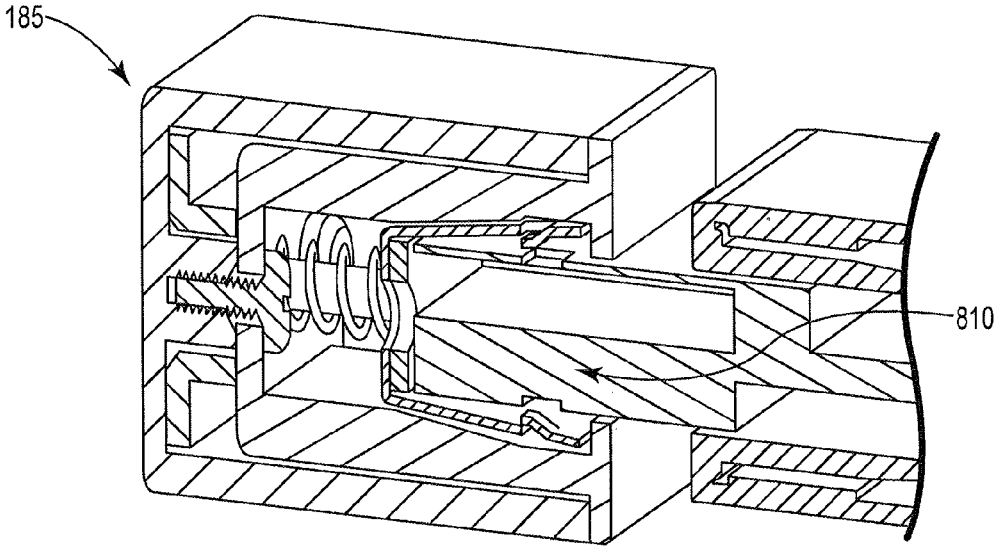
FIGS. 8-13 show the operation of a locking cap with a USB connector, according to various embodiments.

FIG. 8 shows the operation of a locking cap with a USB connector, according to one embodiment. FIG. 8 shows a USB connector 810, before it is more fully inserted inside of the locking cap 185. In the illustrated embodiment, the holder (e.g. holder 160 [FIG. 1]) has an inclined plane. Additionally, the hook (e.g. hook 130 [FIG. 1], including one or more engagement points 210 [FIG. 2]) is at open status.

Figure 9:
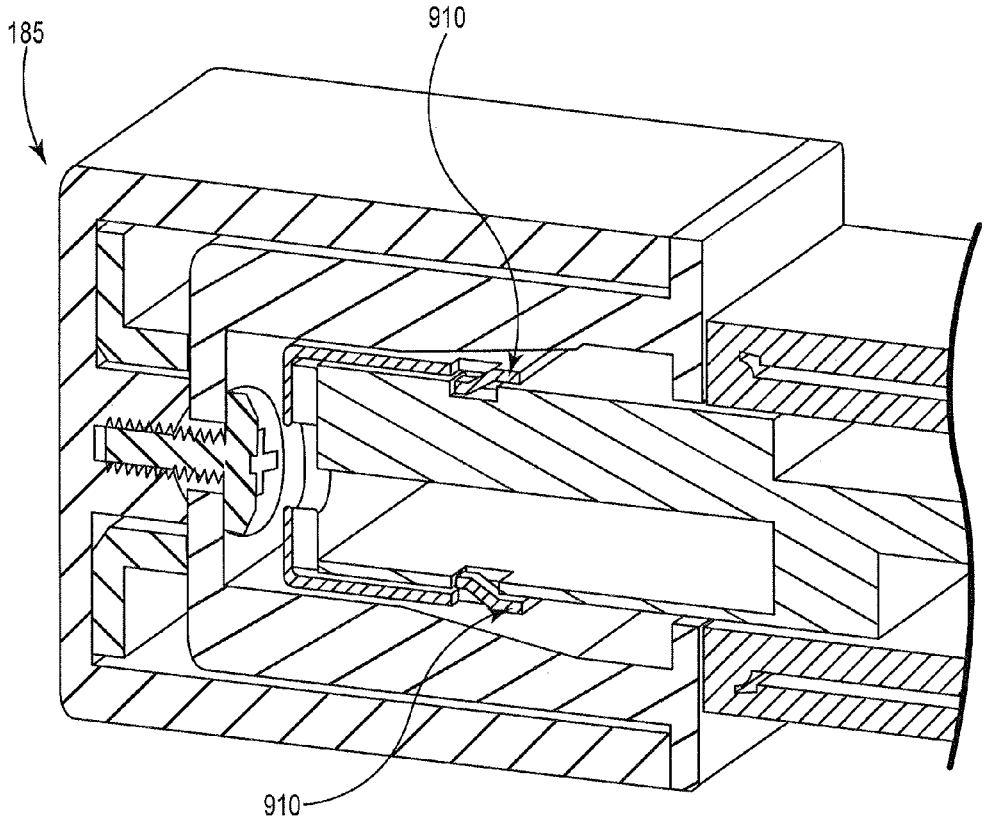

FIG. 9 shows the operation of a locking cap with a USB connector, according to one embodiment. FIG. 9 shows a USB connector inserted inside of the locking cap 185 as fully as appropriate. In the illustrated embodiment, the engagement points 910 (e.g. engagement points 210 [FIG. 2]) are locking the USB connector.

Figure 10:
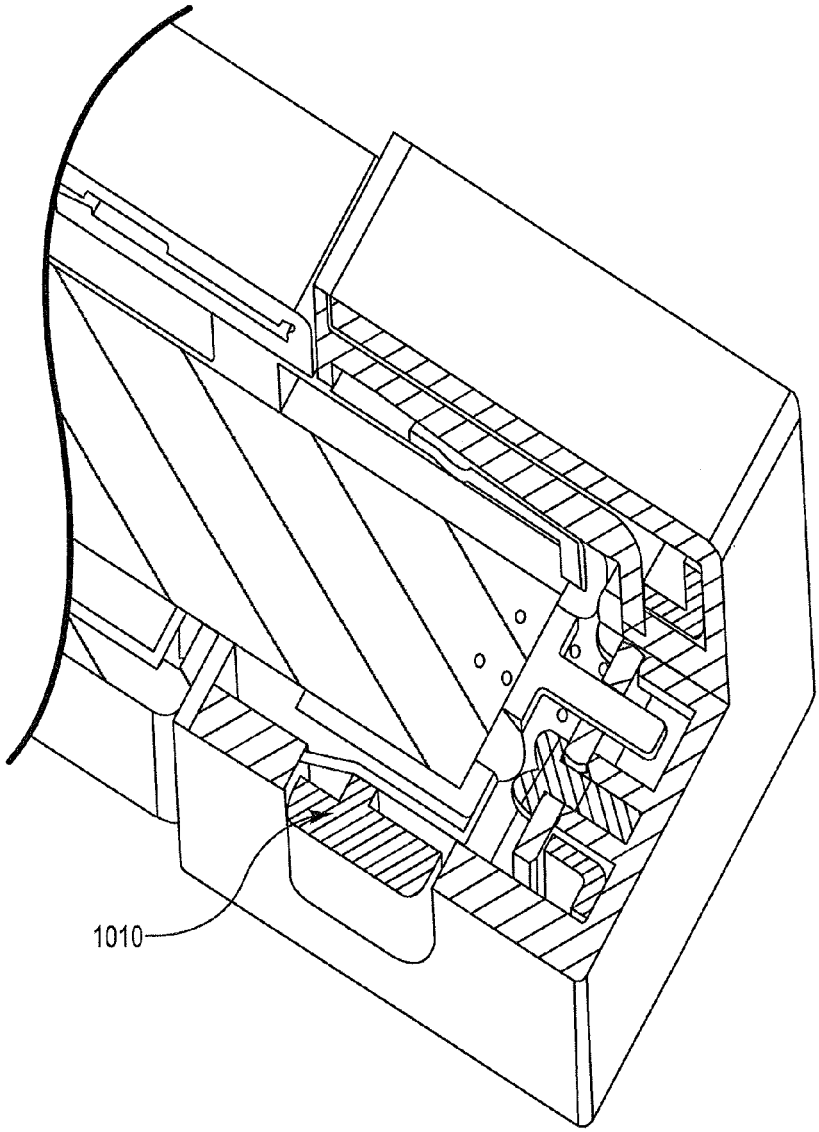

FIG. 10 shows the operation of a locking cap with a USB connector, according to one embodiment. FIG. 10 shows an alternative view of a USB connector inserted inside of the locking cap as fully as appropriate. In the illustrated embodiment, the interplay 1010 between the hook (e.g. hook 130 [FIG. 1], including one or more engagement points 210 [FIG. 2]), and a portion of the button (e.g. portion 170 of button 180 [FIG. 1]) is shown.

Figure 11:
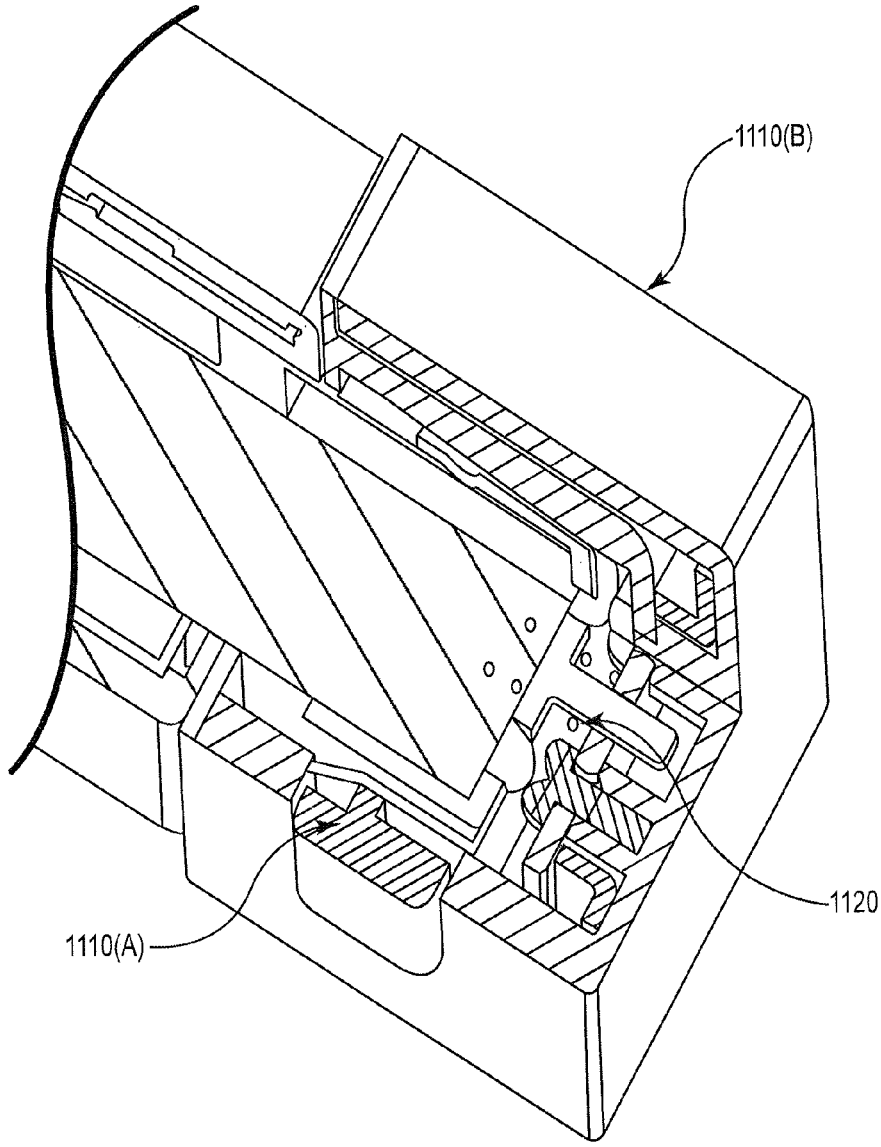

FIG. 11 shows the operation of a locking cap with a USB connector, according to one embodiment. In the illustrated embodiment, the interplay between the spring 1120 (e.g. spring 150 [FIG. 1]), and a portion 1110(A) of the button (e.g. portion 170 of button 180 [FIG. 1]) is shown. Additionally, in the illustrated embodiment, a second button, portion of a button, or other release mechanism is implied at 1110(B), which may be pushed or actuated via other means, in addition to or in lieu of pushing or otherwise actuating the portion 1110(A) of the button, which in part or in concert may trigger the spring 1120 to push out in order to at least partially release or unlock the USB connector.

As already noted herein, according to another embodiment, a locking mechanism for a portable storage device may comprise a hook, a hook bracket at least partially inserted within the hook to form a first assembly, a holder, the holder enclosing at least a portion of the first assembly to form a second assembly, and a release mechanism, the release mechanism associated with at least a portion of the second assembly to form the locking mechanism. In such a case, the release mechanism may mechanically influence (either directly or indirectly) the hook with respect to at least partially releasing or unlocking a USB connector.

Figure 12:
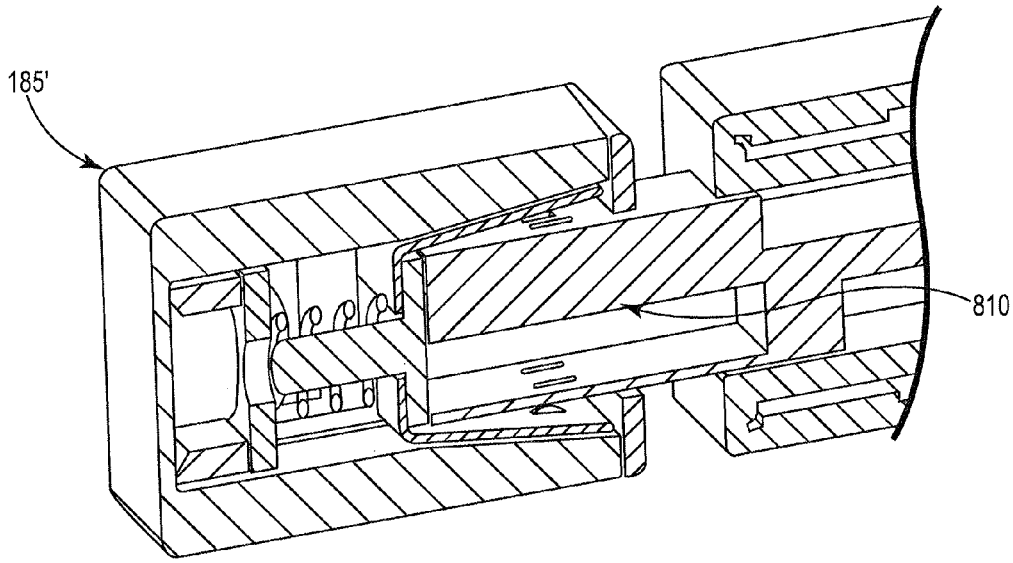

FIG. 12 shows the operation of a locking cap with a USB connector, according to a second embodiment. FIG. 12 shows a USB connector 810 [FIG. 8] before it is inserted inside of the locking cap 185' as fully as appropriate. In the illustrated embodiment, the cap (e.g. cap 190 [FIG. 1]) has an inclined plane. Additionally, the hook (e.g. hook 130 [FIG. 1], including one or more engagement points 210 [FIG. 2]) is at open status.

Figure 13:
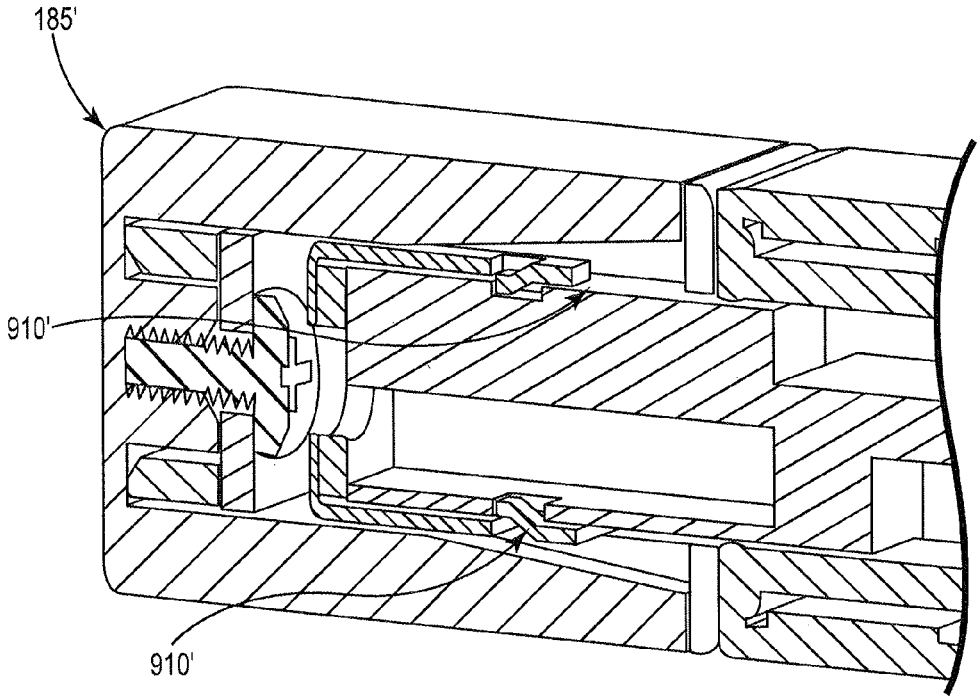

FIG. 13 shows the operation of a locking cap with a USB connector, according to the second embodiment as shown in FIG. 12. FIG. 13 shows a USB connector inserted inside of the locking cap 185' as fully as appropriate. In the illustrated embodiment, the engagement points 910' (e.g. engagement points 210 [FIG. 2]) are locking the USB connector.

Figure 14:
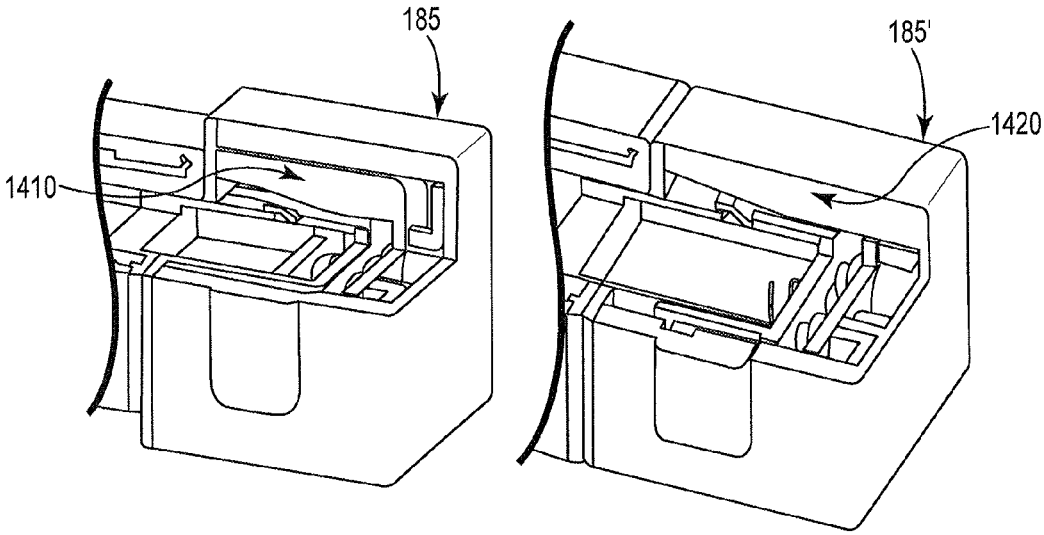
FIG. 14 shows various embodiments of a locking cap.

FIG. 14 shows a comparison of locking cap 185 and locking cap 185.' In locking cap 185, the inclined plane is on the holder 1410. In locking cap 185', the inclined plane is on the interior of the cap 1420. Additionally, in locking cap 185', the thickness of the holder (e.g. holder 160 [FIG. 1]) may overlay with the cap (e.g. cap 190 [FIG. 1]).

Figure 15:
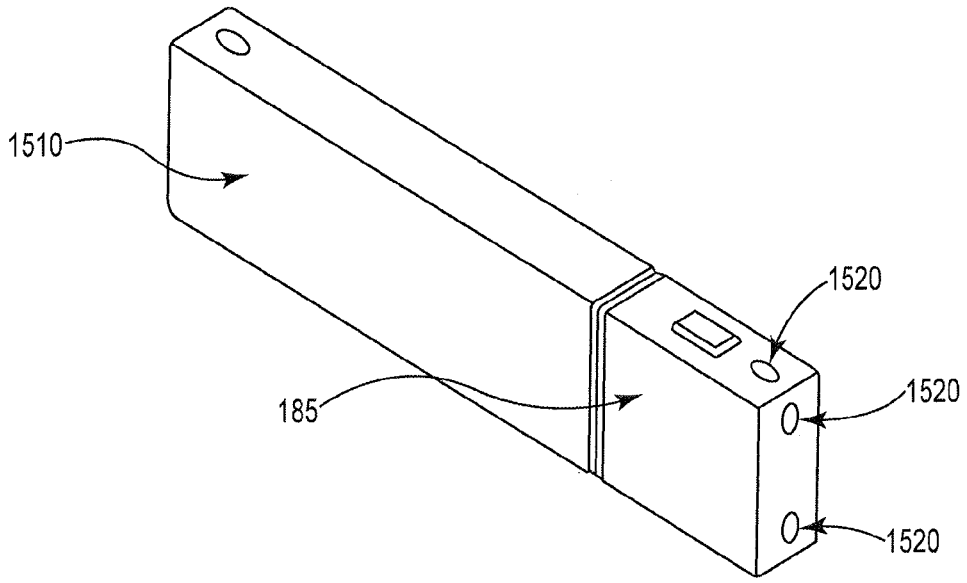
FIG. 15 shows a USB storage device having a locking cap, according to various exemplary embodiments.

FIG. 15 shows a USB storage device having a locking cap, according to various exemplary embodiments. The illustrative USB storage device 1510 includes locking cap 185 attached or locked to a USB connector (under the surface of the locking cap 185). Locking cap 185 may also include one or more connection points 1520. Connection points 1520 may vary with respect to whether one connection point may be hollow all the way through to a second connection point, or whether one or more connection points may be close-ended. One or more connection points 1520 may have a chain, string or other tie mechanism connected or in other contact with the connection point 1520. Such a chain, string or other tie mechanism may be used to connect a locking cap (e.g. locking cap 185), the associated or locked USB connector, and/or a device or other piece of equipment associated with the USB connector (e.g. USB storage device 1510), to some other item, such as a key ring. An advantage of such a set-up (or other similar set-ups with weighted items) is that a USB storage device may be disconnected from a locking cap, and the associated key ring, and inserted into a computer, without having the weight of the key ring and/or keys cause the destruction of or compromise the USB connector, USB storage device and/or the computer. Further, the keys (or other item) may be used without the inconvenience of undocking the USB storage device (or other similar USB item). Additionally, there is a reduced risk of losing an item associated with the locking cap (e.g. a portable USB storage device), since the locking cap has the item securely fastened to another item, such as a key ring. The likelihood of losing an item with various particular embodiments of the locking cap are decreased when two separate spots or locations on the locking cap require simultaneous actuation in order to release or unlock the locking cap. A further advantage of a locking cap is the reduced risk of losing a cap and the resulting exposure of a USB connector. In many cases, the USB connector is the most sensitive portion of the associated device or equipment, with respect to possible damage.

The embodiments discussed herein are illustrative of various examples of the present invention. As these embodiments are described with reference to illustrations, various modifications or adaptations of the methods and/or specific structures described may become apparent to those skilled in the art. All such modifications, adaptations, or variations that rely upon the teachings of the various embodiments of the present invention, and through which these teachings have advanced the art, are considered to be within the scope of the present invention. Hence, these descriptions and drawings should not be considered in a limiting sense, as it is understood that the present invention is in no way limited to only the embodiments illustrated.

What is claimed is:

1. A locking mechanism for a USB connector, the locking mechanism comprising: a hook; a hook bracket at least partially inserted within the hook to form a first assembly; a holder, the holder enclosing at least a portion of the first assembly to form a second assembly; and a button, the button enclosing at least a portion of the second assembly to form the locking mechanism.

2. The locking mechanism of claim 1, the locking mechanism further comprising: a spring fitted around a protruding portion of the hook bracket, the protruding portion extending outwardly from the first assembly.

3. The locking mechanism of claim 1, the locking mechanism further comprising: a screw attaching the first assembly to the holder to form the second assembly.

4. The locking mechanism of claim 1, the locking mechanism further comprising: a cap, the cap enclosing at least a portion of the button to form a locking cap.

5. The locking cap of claim 4, wherein the USB connector is at least partially inserted within the locking cap to attach the locking cap to the USB connector.

6. The locking mechanism of claim 1, wherein the USB connector is at least partially inserted within the locking mechanism to attach the locking mechanism to the USB connector.

7. The locking cap attached to the USB connector of claim 5, wherein the locking cap is detached from the USB connector by applying pressure to a portion of the button.

8. The locking mechanism attached to the USB connector of claim 6, wherein the locking cap is detached from the USB connector by applying pressure to a portion of the button.

9. The locking mechanism of claim 1, wherein the hook is metal, a metal alloy, ceramic, plastic, rubber or a composite fiber.

10. The locking mechanism of claim 1, wherein the hook bracket is metal, a metal alloy, ceramic, plastic, rubber or a composite fiber.

11. The locking mechanism of claim 1, wherein the holder is metal, a metal alloy, ceramic, plastic, rubber or a composite fiber.

12. The locking mechanism of claim 1, wherein the button is metal, a metal alloy, ceramic, plastic, rubber or a composite fiber.

13. The cap of claim 4, wherein the cap is metal, a metal alloy, ceramic, plastic, rubber or a composite fiber.

14. The locking mechanism of claim 1, wherein the USB connector is a USB 2.0 connector that is communicatively coupled with a portable storage device.

15. A locking mechanism for a portable storage device, the locking mechanism comprising: a hook; a hook bracket at least partially inserted within the hook to form a first assembly; a holder, the holder enclosing at least a portion of the first assembly to form a second assembly; and a release mechanism, the release mechanism associated with at least a portion of the second assembly to form the locking mechanism.

16. The locking mechanism of claim 15, wherein a USB connector is at least partially inserted within the locking mechanism to attach the locking mechanism to the USB connector.

17. The locking mechanism attached to the USB connector of claim 16, wherein the locking mechanism is detached from the USB connector by actuation of a release mechanism.

18. A locking cap for a portable storage device, the locking cap comprising: a hook; a hook bracket at least partially inserted within the hook to form a first assembly; a holder, the holder enclosing at least a portion of the first assembly to form a second assembly; a button, the button enclosing at least a portion of the second assembly to form the locking mechanism; a spring fitted around a protruding portion of the hook bracket, the protruding portion extending outwardly from the first assembly; a screw attaching the first assembly to the holder to form the second assembly; and a cap, the cap enclosing at least a portion of the button to form the locking cap.

19. The locking cap of claim 18, wherein a USB connector is at least partially inserted within the locking cap to attach the locking cap to the USB connector.

20. The locking cap attached to the USB connector of claim 19, wherein the locking cap is detached from the USB connector by applying pressure to a portion of the button.

* * * * *